US006317150B1

(12) United States Patent
Ono et al.

(10) Patent No.: US 6,317,150 B1
(45) Date of Patent: Nov. 13, 2001

(54) PROTECTION COVER FOR THERMAL PRINTHEAD, AND THERMAL PRINTHEAD USING THE SAME

(75) Inventors: Shigeyoshi Ono; Takaya Nagahata; Yasuhiro Yoshikawa, all of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/545,745

(22) Filed: Apr. 5, 2000

(30) Foreign Application Priority Data

Apr. 13, 1999 (JP) ..... 11-104816

(51) Int. Cl.[7] ..... B41J 2/335
(52) U.S. Cl. ..... 347/200
(58) Field of Search ..... 347/200, 209, 347/210

(56) References Cited

U.S. PATENT DOCUMENTS 5,353,045 * 10/1994 Sako ..... 347/200
5,739,837 * 4/1998 Nagahata et al. ..... 347/200
5,874,983 * 2/1999 Nagahata et al. ..... 347/200

FOREIGN PATENT DOCUMENTS 8-258309 3/1995 (JP) .
11-188906 * 7/1999 (JP) .

* cited by examiner

*Primary Examiner*—Huan Tran
(74) *Attorney, Agent, or Firm*—Merchant & Gould P.C.

(57) ABSTRACT

A protection cover for a thermal printhead includes an elongated body and two bosses formed on the lower surface of the elongated body. These bosses are arranged to slant with each other when the cover is fixed to the thermal printhead. Thus, the protection cover, which is originally flat, is caused to warp so that its central portion is raised above its end portions.

10 Claims, 5 Drawing Sheets

PROTECTION COVER FOR THERMAL PRINTHEAD, AND THERMAL PRINTHEAD USING THE SAME

BACKGROUND OF THE INVENTION

1. Field of the Invention

The present invention relates to a protection cover for a thermal printhead. The present invention also relates to a thermal printhead utilizing such a protection cover.

2. Description of the Related Art

A conventional thermal printhead used in combination with a protection cover is disclosed in JP-A-8(1996)-258309 for example. The conventional printhead includes an elongated head substrate provided with a heating resistor, and a circuit board formed with a predetermined wiring pattern. The circuit board carries a connector electrically connected to the wiring pattern. The head substrate and the circuit board are both mounted on a heat sink. The conventional printhead also includes a protection cover made of synthetic resin. The protection cover is provided for covering the circuit board and part of the head substrate.

The conventional protection cover is made by molding a thermosetting resin such as epoxy. In this way, however, the resulting protection cover tends to deform, for instance, when it cools after being removed from the dies. Thus, it can happen that the finally obtained protection cover may unduly warp downward, with its respective ends raised above its longitudinal center.

Disadvantageously, when the deformed protection cover is used for the conventional thermal printhead, the platen roller may fail to uniformly press a recording paper sheet or transfer ink ribbon onto the protection cover. Consequently, the recording paper sheet and/or the ink ribbon may be unduly strongly pressed onto one (or both) of the longitudinal ends of the protection cover, and therefore torn or wrinkled through the uneven contact with the protection cover.

The above problem may be eliminated by causing the resulting protection cover to have an upwardly warping form, i.e., with its longitudinal center raised above its respective ends. With such an arrangement, the recording paper sheet and/or ink ribbon are relatively strongly pressed onto the central portion of the protection cover only. Thus, the recording paper sheet and/or ink ribbon will not be torn nor wrinkled.

Conventionally, the convex protection cover is formed by using a particularly configured die whose inner surface (shape-defining surface) is upwardly warped in correspondence to the protection cover to be produced. However, it is often quite difficult to process a die to have such a particularly configured inner surface, or even impossible to do so without employing a special processing technique. Thus, forming the upwardly warped protection cover is often time-consuming and/or troublesome, thereby leading to an unduly large cost increase.

SUMMARY OF THE INVENTION

The present invention has been proposed under the circumstances described above, and its object is to provide a protection cover which is free from suffering the above disadvantages.

Another object of the present invention is to provide a thermal printhead utilizing such a novel protection cover.

According to a first aspect of the present invention, there is provided a protection cover for a thermal printhead comprising:

an elongated body having an upper surface and a lower surface; and first and second bosses formed on said lower surface and spaced from each other longitudinally of the elongated body;

wherein the elongated body is originally flat, but caused to warp for use on the thermal printhead in a manner such that a central portion of said upper surface is raised above end portions of said upper surface.

Since the elongated body of the above protection cover is originally flat, there is no need to prepare a specially configured die for molding the protection cover. Thus, the protection cover of the present invention is produced readily and at a low cost.

In a preferred embodiment, the elongated body may be formed with a first through-hole and a second through-hole which extend through the first boss and the second boss, respectively.

Preferably, the first boss and the second boss may be provided with a first protrusion and a second protrusion, respectively. In this case, the first and the second protrusions may be located between the first and the second through-holes, as viewed longitudinally of the protection cover.

In another preferred embodiment, each of the first and the second bosses may be nonuniform in wall thickness.

According to a second aspect of the present invention, there is provided a thermal printhead comprising:

a circuit board;

a heat sink for supporting the circuit board; and an elongated protection cover fixed to the heat sink;

wherein the protection cover is provided with at least first and second bosses and caused to warp in a manner such that a central portion of the protection cover is raised above end portions of the protection cover.

Preferably, each of the first and the second bosses may be provided with a protrusion contacting with the circuit board.

Preferably, the thermal printhead of the present invention may further comprise a step member formed on the circuit board. Each of the first and the second bosses may be arranged to overlap on the step member. In this case, the above-mentioned protrusions formed on the first and the second bosses may be omitted. The step member may be a protection layer formed on the circuit board. Alternatively, the step member may be a protrusion formed on the circuit board.

When the above-mentioned protrusions are omitted, each of the first and the second bosses may include an inner part and an outer part, wherein the inner part is closer to the other boss than the outer part is, and the inner part is rendered thicker than the outer part.

Other features and advantages of the present invention will become apparent from the detailed description given below with reference to the accompanying drawings.

DETAILED DESCRIPTION OF THE PREFERRED EMBODIMENTS

The preferred embodiments of the present invention will be described below with reference to the accompanying drawings.

Figure 1:
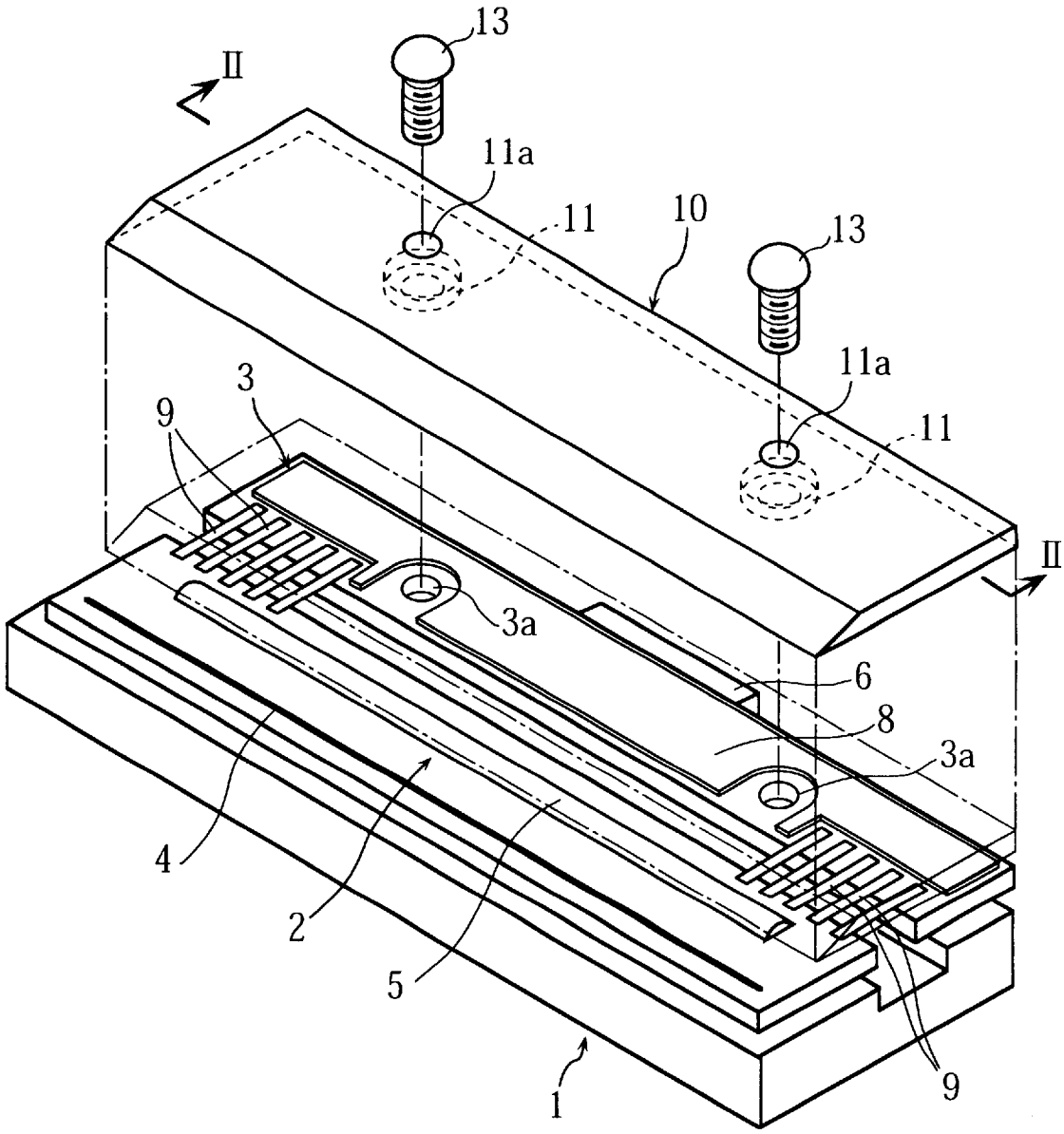
FIG. 1 is a perspective view showing a thermal printhead provided with a protection cover according to a first embodiment of the present invention.
Figure 2:
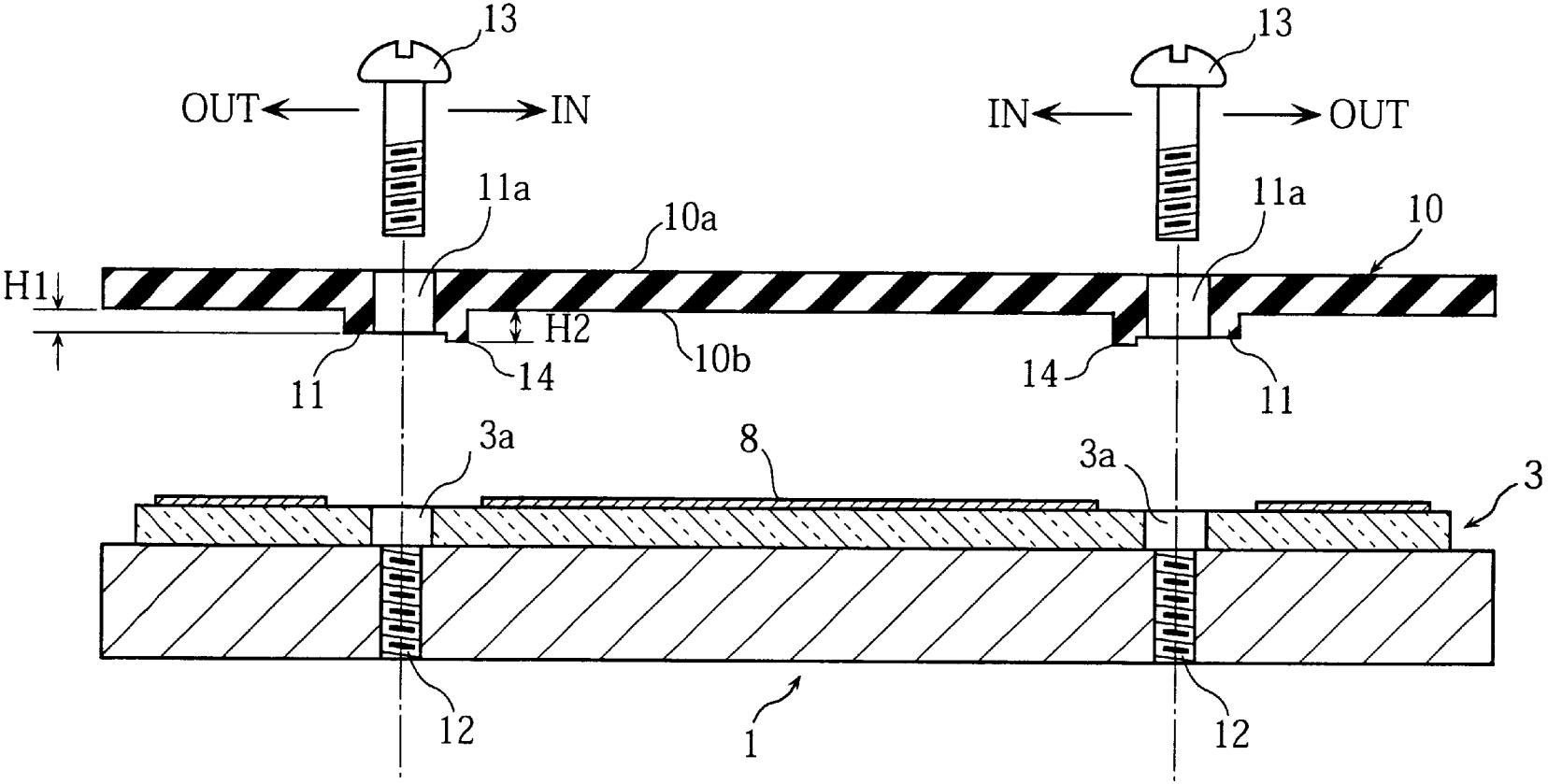
FIG. 2 is a sectional view taken along lines II—II in FIG. 1.
Figure 3:
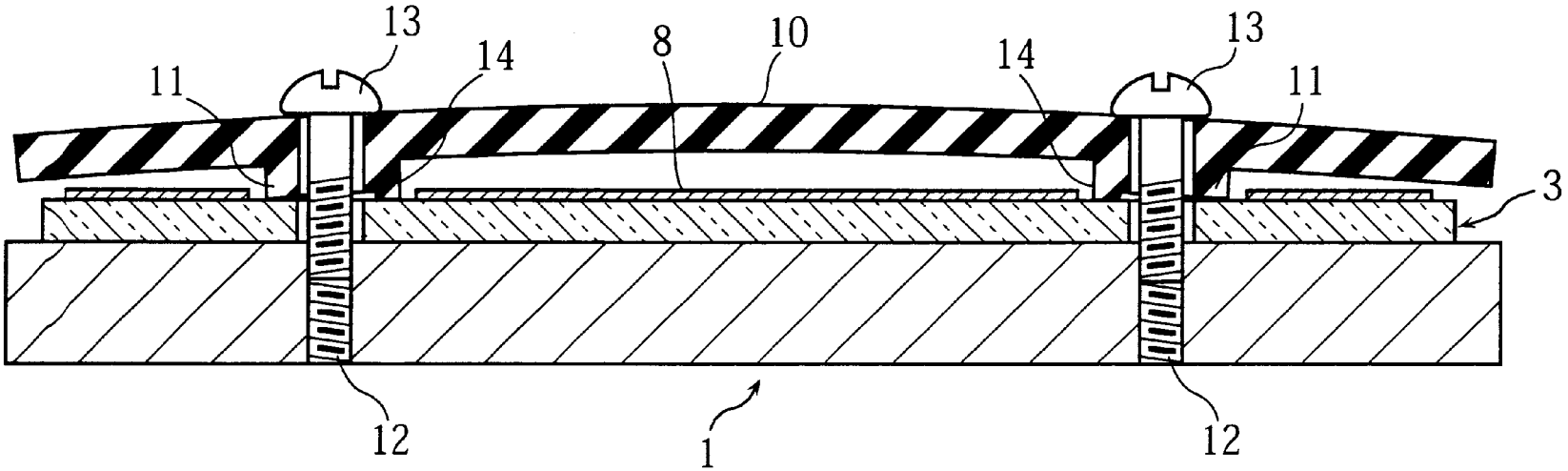
FIG. 3 is a sectional view showing the thermal printhead of FIG. 1, with the protection cover fixed in place.

Referring first to FIGS. 1–3, a thermal printhead according to a first embodiment of the present invention will be described below.

As illustrated, the thermal printhead of this embodiment includes a metal heat sink 1 made of e.g. aluminum. The heat sink 1 supports, at its upper surface, a head substrate 2 and a circuit board 3 which are arranged side by side. The head substrate 2 may be made of a ceramic material, while the circuit board 3 may be made of a synthetic resin. An adhesive may be used for fixing the head substrate 2 and the circuit board 3 to the heat sink 1.

The upper surface of the head substrate 2 is provided with an elongated heating resistor 4 extending longitudinally of the head substrate 2. A cover coating 5 is also formed on the upper surface of the head substrate 2. The cover coating 5 extends in parallel to the heating resistor 4. Though not shown, the cover coating 5 encloses a plurality of drive ICs to actuate the heating resistor 4.

The upper surface of the circuit board 3 is provided with a predetermined wiring pattern (not shown) coated with a protection layer 8. The nonillustrated wiring pattern is electrically connected to a connector 6 supported by the circuit board 3.

For electrically connecting the drive ICs (on the head substrate 2) to the wiring pattern (on the circuit board 3), use is made of a plurality of leads 9 bridging a gap between the head substrate 2 and the circuit board 3.

Numeral 10 refers to a protection cover for covering the coating 5 on the head substrate 2 and the entire upper surface of the circuit board 3. The protection cover 10 may be made by molding a heat-resistant synthetic resin material. As shown in FIGS. 1 and 2, the protection cover 10 includes an elongated body having an upper surface 10*a* and a lower surface 10*b*. According to the present invention, the protection cover 10 may be mounted on the heat sink 1 in the following manner.

As shown in FIGS. 1 and 2, the lower surface 10*b* of the protection cover 10 is provided with two bosses 11 spaced longitudinally of the protection cover 10. The protection cover 10 is formed, at the respective bosses 11, with vertically extending through-holes 11*a* for allowing insertion of bolts 13. The through-holes 11*a* are greater in diameter than the shank of the bolts 13 for receiving the bolts 13 loosely.

Correspondingly in position to the through-holes 11*a* of the protection cover 10, the circuit board 3 is formed with two bores 3*a* extending through the thickness of the circuit board 3, while the heat sink 1 is formed with two internally threaded holes 12 coming into engagement with the bolts 13, respectively. The bores 3*a* of the circuit board 3 may be substantially equal in diameter to the through-hole 11*a* of the protection cover 10, though such an arrangement is only exemplary and the present invention is not limited to this. With the above arrangement, the protection cover 10 is firmly attached to the heat sink 1 by screwing the bolts 13 into the threaded holes 12 of the heat sink 1.

As best shown in FIG. 2, the protection cover 10 is provided, at each boss 11, with a downward protrusion 14. As viewed longitudinally of the cover 10, the protrusions 14 are both arranged between the two through-holes 11*a*. In this specification, a direction going from any one of the two through-holes 11*a* to the other is referred to as "inward", while a direction opposite to the inward direction is referred to as "outward." According to this definition, the protrusion 14 at each boss 11 is located "inward" of a relevant one of the two through-holes 11*a*. Due to the presence of the protrusions 14, each boss 11 has an outward height H1 and an inward height H2 which is greater than the outward height H1.

With the above arrangement, the originally flat protection cover 10 (see FIG. 2) is convexly warped, as shown in FIG. 3, when the cover 10 is bolted to the heat sink 1. Specifically, in attaching the protection cover 10 to the heat sink 1, first, the protrusions 14 are brought into contact with the upper surface of the circuit board 3. Then, as the bolts 13 are screwed further into the threaded holes 12, each boss 11 is slanted outward, until the outward side of the boss 11 touches the upper surface of the circuit board 3. As a result, the protection cover 10 as a whole is caused to warp, as shown in FIG. 3, with its central portion of the cover 10 being raised above the free ends.

In the illustrated embodiment, the bosses 11 of the protection cover 10 are held in contact with the circuit board 3. Alternatively, the bosses 11 may be directly supported by the upper surface of the heat sink 1. In this case, the bores 3*a* of the circuit board 3 need to be larger so that the bosses 11 are entirely accommodated in the bores 3*a*. Further, the protrusions 14, which are formed on the protection cover 10, may be provided on the circuit board 3 or heat sink 1. For avoiding a cost increase, however, the protrusions 14 may preferably be formed on the bosses 11.

Figure 4:
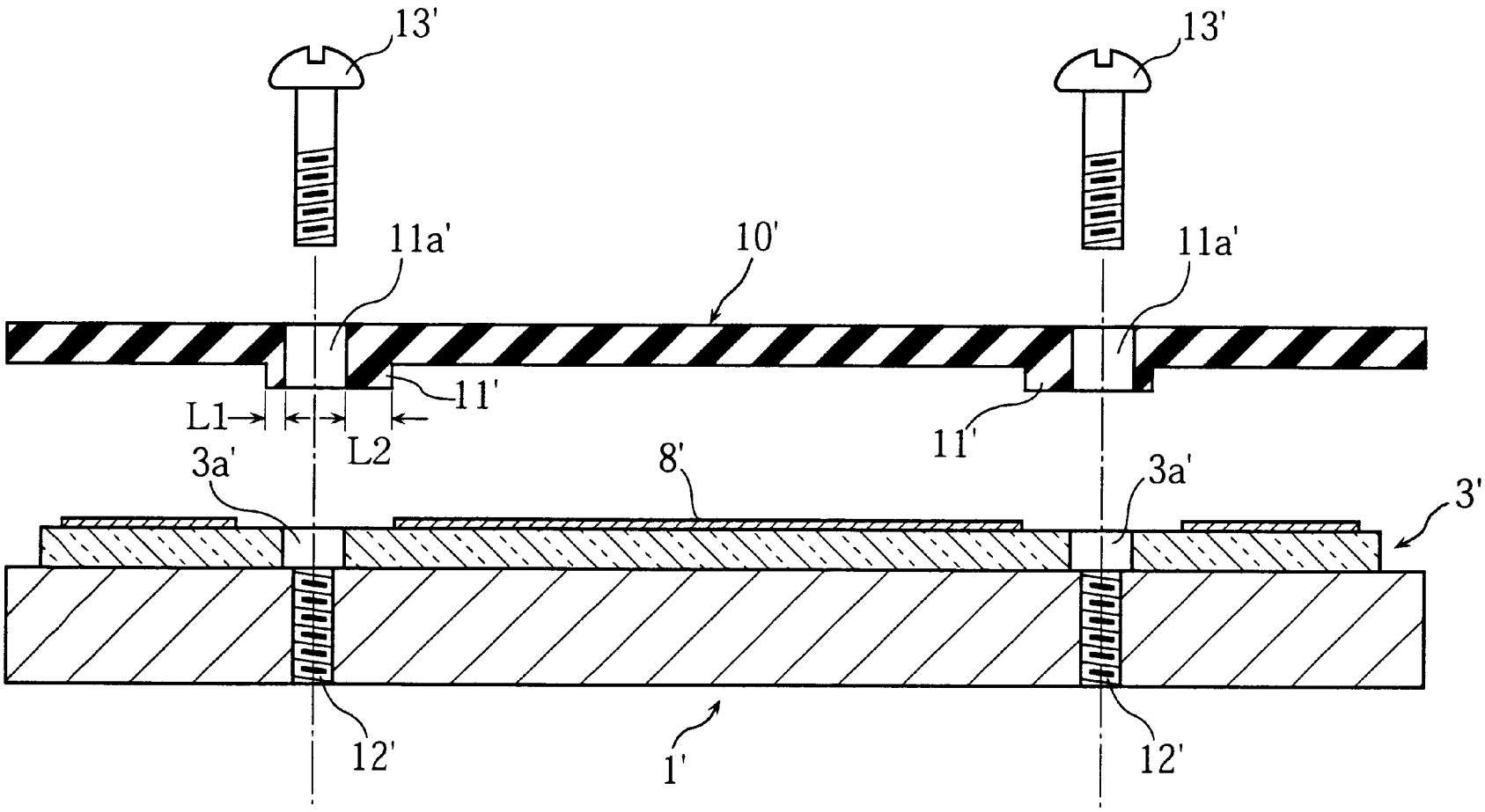
FIG. 4 is a sectional view showing a thermal printhead provided with a protection cover according to a second embodiment of the present invention.
Figure 5:
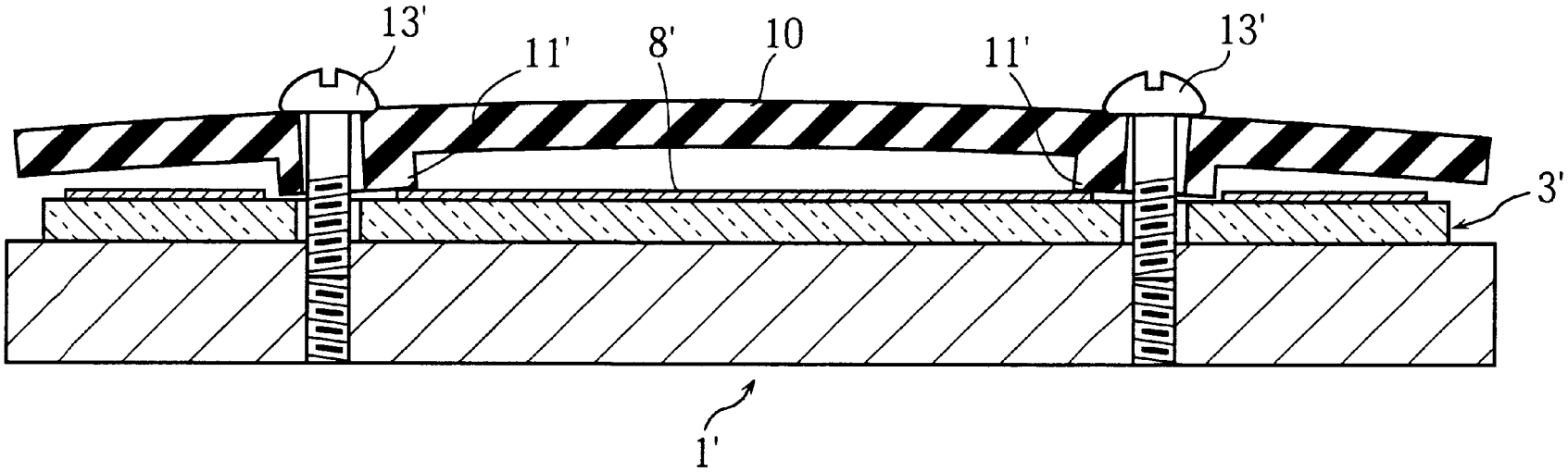
FIG. 5 is a sectional view showing the thermal printhead of FIG. 4, with the protection cover fixed in place.

Reference is now made to FIGS. 4 and 5 showing a thermal printhead according to a second embodiment of the present invention. The illustrated thermal printhead is basically similar to the thermal printhead of the first embodiment described above.

Specifically, as in the first embodiment, the thermal printhead of the second embodiment includes a heat sink 1', a circuit board 3', a head substrate (not shown), a protection layer 8' formed on the circuit board 3', and a protection cover 10'.As illustrated, the protection cover 10' and the circuit board 3' are formed with two through-holes 11*a'* and two bores 3*a'*, respectively, for allowing insertion of fixing bolts 13'.Correspondingly, the heat sink 1' is formed with two internally threaded holes 12' to come into engagement with the bolts 13', which are externally threaded. The protection cover 10' is provided, at its through-holes 11*a'*, with bosses The thermal printhead of the second embodiment differs from the previous one in that no protrusions are provided at the bosses 11' of the protection cover 10'.Further, as shown in FIG. 4, each boss 11' is rendered nonuniform in size or wall thickness.

Specifically, each boss 11' has an outer wall thickness L1 and an inner wall thickness L2 which is greater than the outer wall thickness L1. With such an arrangement, each boss 11' partially rides (overlaps) on the protection layer 8', so that the bosses 11' contact with the protection layer 8' between the fixing bolts 13', as shown in FIG. 5. In this manner, the protection layer 8' serves as a step member for the bosses 11', while also serving to protect non-illustrated wiring patterns on the circuit board 3'.On the opposite sides, each of the bosses 11' does not ride on the protection layer 8' but is caused to directly contact with the circuit board 3'.

With such an arrangement again, the protection cover 10' advantageously warps in an upwardly convex manner (FIG.

5) when it is bolted to the heat sink 1'.Thus, in the second embodiment, a recording paper sheet and/or ink ribbon will not be torn or wrinkled through contact with the protection cover 10'.Further, according to the second embodiment, there is no need to provide the bosses 11' with protrusions for warping the protection cover 10'.Thus, the thermal printhead of the second embodiment does not give rise to a cost increase.

In the first and the second embodiments described above, the protection cover 10 or 10' is formed with two bosses 11 or 11'.According to the present invention, however, the number of the bosses is not limited to these examples. The protection cover 10 or 10' may be provided with more than two bosses. Further, in the second embodiment, the bosses 11' of the protection cover 10' are arranged to overlap on the protection layer 8', so that the cover 10' warps in a desired manner. Alternatively, in place of the protection layer 8', use may be made of protrusions formed on the circuit board 3' for slanting the bosses 11' in the manner shown in FIG. 5.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A protection cover for a thermal printhead comprising:

an elongated body having an upper surface and a lower surface;

first and second bosses formed on said lower surface and spaced from each other longitudinally of the elongated body; and means for causing the elongated body, which is originally flat, to warp for use on the thermal printhead in a manner such that a central portion of said upper surface is raised above end portions of said upper surface.

2. The protection cover according to claim 1, wherein the elongated body is formed with a first through-hole and a second through-hole which extend through the first boss and the second boss, respectively.

3. The protection cover according to claim 1, wherein the first boss and the second boss are provided with a first protrusion and a second protrusion, respectively.

4. The protection cover according to claim 3, wherein the first and the second protrusions are located between the first and the second through-holes.

5. The protection cover according to claim 2, wherein each of the first and the second bosses is nonuniform in wall thickness.

6. A thermal printhead comprising:

a circuit board;

a heat sink for supporting the circuit board; and an elongated protection cover fixed to the heat sink;

wherein the protection cover is provided with at least first and second bosses and includes means for causing the protection cover to warp in a manner such that a central portion of the protection cover is raised above end portions of the protection cover.

7. The thermal printhead according to claim 6, wherein each of the first and the second bosses is provided with a protrusion contacting with the circuit board.

8. The thermal printhead according to claim 6, further comprising a step member formed on the circuit board, wherein each of the first and the second bosses overlaps on the step member.

9. The thermal printhead according to claim 8, wherein each of the first and the second bosses includes an inner part and an outer part, the inner part being closer to the other boss than the outer part is, the inner part being thicker than the outer part.

10. The thermal printhead according to claim 8, wherein the step member comprises a protection layer formed on the circuit board.

* * * * *